US008448806B2

(12) United States Patent
Hassell

(10) Patent No.: US 8,448,806 B2
(45) Date of Patent: May 28, 2013

(54) LOW DEPTH CRATE

(75) Inventor: Jon P. Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 13/346,913

(22) Filed: Jan. 10, 2012

(65) Prior Publication Data

US 2012/0103996 A1 May 3, 2012

Related U.S. Application Data

(63) Continuation of application No. 12/619,143, filed on Nov. 16, 2009.

(51) Int. Cl.

| | |
|---|---|
| ***B65D 1/36*** | (2006.01) |
| ***B65D 25/10*** | (2006.01) |
| ***B65D 85/00*** | (2006.01) |

(52) U.S. Cl.

USPC ..... 220/516; 220/509; 206/203

(58) Field of Classification Search

USPC ..... 220/509, 516–518; 206/203, 427

See application file for complete search history.

(56) References Cited

U.S. PATENT DOCUMENTS

| | | | |
|---|---|---|---|
| 820,445 | A | 5/1906 | Speer |
| D103,862 | S | 3/1937 | Randall et al. |
| 2,411,673 | A | 11/1946 | Vechey, Jr. |
| D147,981 | S | 11/1947 | Lehman |
| D152,907 | S | 3/1949 | Richards |
| 2,588,805 | A | 3/1950 | Cross |
| 2,512,855 | A | 6/1950 | Erickson |
| 2,526,335 | A | 10/1950 | Deichert |
| 2,530,481 | A | 11/1950 | Rawn, Jr. |
| 2,535,493 | A | 12/1950 | Gerber |
| 2,626,079 | A | 1/1953 | Keller |
| D172,664 | S | 7/1954 | Emery |
| 2,743,030 | A | 4/1956 | Read, Jr. |
| 2,840,256 | A | 6/1958 | Cobb, Jr. |
| 2,928,530 | A | 3/1960 | Sauey |
| 2,935,222 | A | 5/1960 | O'Connell |
| 2,970,715 | A | 2/1961 | Kappel et al. |
| D189,891 | S | 3/1961 | Schilling et al. |
| 2,979,222 | A | 4/1961 | Levine |

(Continued)

FOREIGN PATENT DOCUMENTS

| | | |
|---|---|---|
| BE | 680197 | 10/1966 |
| BE | 693216 | 1/1967 |

(Continued)

OTHER PUBLICATIONS

European Search Report for EP Application No. 09012596.4, Jan. 25, 2010.

(Continued)

*Primary Examiner* — Harry Grosso

(74) *Attorney, Agent, or Firm* — Carlson, Gaskey & Olds, P.C.

(57) ABSTRACT

A crate according to one embodiment of the present invention includes a base, a pair of opposed side walls extending upward from the sides of the base and a pair of end walls extending upward from ends of the base. The end walls each include a pair of spaced apart end columns each having a side flange partially defining a bottle receiving pocket and a lower rib projecting upwardly from the base between the side flanges. A handle extends across the pair of spaced apart columns at each end wall.

19 Claims, 9 Drawing Sheets

U.S. PATENT DOCUMENTS

| | | | |
|---|---|---|---|
| 3,009,579 | A | 11/1961 | Ettlinger, Jr. |
| 3,055,531 | A | 9/1962 | De Chelbor |
| 3,055,542 | A | 9/1962 | Russo |
| 3,092,284 | A | 6/1963 | Stout |
| D195,702 | S | 7/1963 | Russo |
| 3,151,762 | A | 10/1964 | Vidal |
| 3,184,148 | A | 5/1965 | Poupitch |
| D201,257 | S | 6/1965 | Vidal |
| 3,247,996 | A | 4/1966 | Garcia |
| 3,283,947 | A | 11/1966 | Cornelius |
| 3,297,190 | A | 1/1967 | Cloyd |
| 2,974,819 | A | 3/1967 | Melville |
| D208,111 | S | 7/1967 | Vidal |
| 3,332,574 | A | 7/1967 | Earp |
| 3,333,727 | A | 8/1967 | Belcher et al. |
| 3,333,729 | A | 8/1967 | Rabb |
| 3,334,767 | A | 8/1967 | Cornelius et al. |
| 3,349,943 | A | 10/1967 | Box |
| D209,864 | S | 1/1968 | Versteeg et al. |
| 3,376,998 | A | 4/1968 | Cornelius |
| 3,384,261 | A | 5/1968 | Austin |
| 3,390,801 | A | 7/1968 | Adomat |
| 3,391,814 | A | 7/1968 | Box |
| 3,391,815 | A | 7/1968 | Box |
| 3,392,869 | A | 7/1968 | Needt |
| 3,416,694 | A | 12/1968 | Bebb |
| 3,428,207 | A | 2/1969 | Schoeller |
| 3,517,852 | A | 6/1970 | Schoeller |
| 3,628,684 | A | 12/1971 | Sere |
| 3,638,824 | A | 2/1972 | Sekiguchi et al. |
| 3,701,449 | A | 10/1972 | Schoeller |
| 3,759,416 | A | 9/1973 | Constantine |
| D229,674 | S | 12/1973 | Quigg |
| 3,812,996 | A | 5/1974 | Bunnell |
| 3,865,239 | A | 2/1975 | Herolzer et al. |
| 3,949,876 | A | 4/1976 | Bridges et al. |
| 3,991,879 | A | 11/1976 | Hirota |
| 3,998,237 | A | 12/1976 | Kressin et al. |
| 3,998,328 | A | 12/1976 | Box |
| 4,027,796 | A | 6/1977 | Martin |
| 4,037,722 | A | 7/1977 | Bremer |
| 4,040,517 | A | 8/1977 | Torokvei |
| 4,071,162 | A | 1/1978 | Steinlein et al. |
| 4,095,720 | A | 6/1978 | Delbrouck et al. |
| 4,101,049 | A | 7/1978 | Wallace et al. |
| 4,161,259 | A | 7/1979 | Palafox |
| 4,162,738 | A | 7/1979 | Wright |
| 4,202,448 | A | 5/1980 | Jaeger et al. |
| 4,204,596 | A | 5/1980 | Davis |
| 4,319,685 | A | 3/1982 | David |
| 4,344,530 | A | 8/1982 | deLarosiere |
| D266,709 | S | 10/1982 | Box |
| 4,410,099 | A | 10/1983 | deLarosiere |
| 4,416,373 | A | 11/1983 | deLarosiere |
| D275,142 | S | 8/1984 | Torokvei |
| 4,538,742 | A | 9/1985 | Prodel |
| 4,548,320 | A | 10/1985 | Box |
| D283,103 | S | 3/1986 | Cushing et al. |
| D284,841 | S | 7/1986 | Rowland et al. |
| D289,938 | S | 5/1987 | Warwick |
| D291,178 | S | 8/1987 | Toms |
| 4,700,836 | A | 10/1987 | Hammett |
| 4,700,837 | A | 10/1987 | Hammett |
| D295,107 | S | 4/1988 | Frost |
| 4,773,554 | A | 9/1988 | Warwick |
| 4,789,063 | A | 12/1988 | Hammett |
| 4,848,580 | A | 7/1989 | Wise |
| D304,123 | S | 10/1989 | Warwick |
| 4,899,874 | A | 2/1990 | Apps et al. |
| 4,911,303 | A | 3/1990 | Andersson |
| 4,928,841 | A | 5/1990 | Arthurs |
| 4,932,532 | A | 6/1990 | Apps et al. |
| 4,978,000 | A | 12/1990 | Mohr |
| 4,978,002 | A | 12/1990 | Apps et al. |
| D313,493 | S | 1/1991 | Apps et al. |
| D317,670 | S | 6/1991 | Apps |
| D318,552 | S | 7/1991 | Apps |
| 5,031,774 | A | 7/1991 | Morris et al. |
| D319,129 | S | 8/1991 | Apps et al. |
| D320,298 | S | 9/1991 | Apps et al. |
| 5,060,819 | A | 10/1991 | Apps |
| 5,071,026 | A | 12/1991 | Apps |
| 5,096,085 | A | 3/1992 | Eek et al. |
| D325,279 | S | 4/1992 | Apps |
| 5,105,948 | A | 4/1992 | Morris et al. |
| D326,749 | S | 6/1992 | Apps et al. |
| D327,357 | S | 6/1992 | Rehrig |
| D327,972 | S | 7/1992 | Apps et al. |
| D329,931 | S | 9/1992 | Apps |
| D329,932 | S | 9/1992 | Apps |
| 5,184,748 | A | 2/1993 | Apps |
| 5,267,649 | A | 12/1993 | Apps et al. |
| 5,305,884 | A | 4/1994 | Apps et al. |
| 5,316,172 | A | 5/1994 | Apps et al. |
| 5,320,245 | A | 6/1994 | Apps et al. |
| 5,335,814 | A | 8/1994 | Hepp |
| D350,438 | S | 9/1994 | Apps et al. |
| 5,351,814 | A | 10/1994 | Apps |
| 5,377,862 | A | 1/1995 | Oakes et al. |
| 5,405,042 | A | 4/1995 | Apps et al. |
| 5,421,477 | A | 6/1995 | Hammett |
| D360,758 | S | 8/1995 | Umiker |
| D361,431 | S | 8/1995 | Koefelda |
| 5,465,843 | A | 11/1995 | Koefelda |
| 5,487,487 | A | 1/1996 | Hammett |
| 5,495,945 | A | 3/1996 | Apps et al. |
| 5,501,352 | A | 3/1996 | Apps |
| 5,529,176 | A | 6/1996 | Apps et al. |
| 5,575,390 | A | 11/1996 | Apps et al. |
| D378,249 | S | 3/1997 | Apps et al. |
| D379,121 | S | 5/1997 | Apps et al. |
| D379,717 | S | 6/1997 | Apps et al. |
| D380,613 | S | 7/1997 | Apps et al. |
| D380,901 | S | 7/1997 | Apps et al. |
| 5,651,461 | A | 7/1997 | Apps et al. |
| 5,660,279 | A | 8/1997 | Apps et al. |
| 5,704,482 | A | 1/1998 | Apps et al. |
| 5,769,230 | A | 6/1998 | Koefelda |
| D395,954 | S | 7/1998 | Apps et al. |
| D399,060 | S | 10/1998 | Apps et al. |
| D400,012 | S | 10/1998 | Apps |
| 5,823,376 | A | 10/1998 | McGrath |
| D401,764 | S | 12/1998 | Apps et al. |
| 5,842,572 | A | 12/1998 | Apps et al. |
| D404,204 | S | 1/1999 | Apps |
| 5,855,277 | A | 1/1999 | Apps et al. |
| D410,778 | S | 6/1999 | Apps et al. |
| D412,399 | S | 8/1999 | Apps et al. |
| 5,964,343 | A | 10/1999 | Steiner |
| 5,971,204 | A | 10/1999 | Apps |
| 5,979,654 | A | 11/1999 | Apps |
| D417,784 | S | 12/1999 | Umiker |
| 6,006,912 | A | 12/1999 | McGrath |
| D420,220 | S | 2/2000 | Apps et al. |
| 6,047,844 | A | 4/2000 | McGrath |
| 6,073,793 | A | 6/2000 | Apps et al. |
| 6,079,554 | A | 6/2000 | Hammett et al. |
| 6,112,938 | A | 9/2000 | Apps |
| 6,131,730 | A | 10/2000 | Hsu |
| 6,189,734 | B1 | 2/2001 | Apps et al. |
| 6,237,758 | B1 | 5/2001 | Hsu |
| D446,015 | S | 8/2001 | Apps |
| D461,957 | S | 8/2002 | Hammett |
| D462,522 | S | 9/2002 | Apps et al. |
| 6,457,599 | B1 | 10/2002 | Apps et al. |
| D465,417 | S | 11/2002 | Apps |
| D466,018 | S | 11/2002 | Apps |
| D468,634 | S | 1/2003 | Hammett |
| D483,946 | S | 12/2003 | Koefelda |
| D485,756 | S | 1/2004 | Apps |
| D487,634 | S | 3/2004 | Apps et al. |
| D494,867 | S | 8/2004 | Apps |
| 6,851,563 | B1 | 2/2005 | Lipari |
| D505,014 | S | 5/2005 | Apps et al. |
| 6,892,885 | B2 | 5/2005 | Apps et al. |
| 6,899,247 | B1 | 5/2005 | Koefelda et al. |
| D507,880 | S | 8/2005 | Hassell et al. |

| | | | |
|---|---|---|---|
| 6,966,442 | B2 | 11/2005 | Hassell et al. |
| 7,017,746 | B2 | 3/2006 | Apps |
| 7,086,531 | B2 | 8/2006 | Apps et al. |
| 7,097,033 | B2 | 8/2006 | Koefelda et al. |
| 7,128,234 | B2 | 10/2006 | Apps et al. |
| 7,207,458 | B1 | 4/2007 | Koefelda et al. |
| 7,252,196 | B1 | 8/2007 | Koefelda et al. |
| 7,281,641 | B2 | 10/2007 | Apps |
| 7,311,217 | B2 | 12/2007 | Apps |
| 7,322,475 | B2 | 1/2008 | Hassell et al. |
| 7,322,486 | B2 | 1/2008 | Koefelda et al. |
| 7,549,539 | B2 | 6/2009 | Apps |
| 7,604,122 | B2 | 10/2009 | Apps et al. |
| 7,677,405 | B2 | 3/2010 | Apps et al. |
| 7,694,839 | B2 | 4/2010 | Koefelda et al. |
| D615,758 | S | 5/2010 | Lindstrom |
| 7,735,676 | B2 | 6/2010 | Ogburn |
| 7,743,939 | B2 | 6/2010 | Stahl |
| 7,950,521 | B2 | 5/2011 | Apps |
| 8,056,753 | B2 | 11/2011 | Koefelda et al. |
| 2002/0148837 | A1 | 10/2002 | Apps |
| 2002/0195452 | A1 | 12/2002 | Apps |
| 2007/0246392 | A1 | 10/2007 | Stahl |
| 2009/0242568 | A1 | 10/2009 | Apps |
| 2010/0084297 | A1 | 4/2010 | Apps |
| 2010/0084302 | A1 | 4/2010 | Apps |
| 2011/0056861 | A1 | 3/2011 | Apps |

FOREIGN PATENT DOCUMENTS

| | | |
|---|---|---|
| CA | 965056 | 3/1975 |
| CA | 1109433 | 9/1981 |
| DE | 1207268 | 12/1965 |
| DE | 2837910 | 3/1980 |
| EP | 0099827 | 10/1986 |
| EP | 0210712 | 8/1990 |
| EP | 0 464 894 | 1/1992 |
| EP | 0915021 | 5/1999 |
| EP | 1008527 | 11/1999 |
| EP | 2 107 006 | 10/2009 |
| FR | 1285689 | 1/1962 |
| FR | 1350962 | 12/1963 |
| FR | 1351218 | 12/1963 |
| FR | 1518610 | 2/1968 |
| FR | 2302244 | 2/1975 |
| GB | 758817 | 10/1956 |
| GB | 943947 | 12/1963 |
| GB | 1032916 | 6/1966 |
| GB | 1115343 | 5/1968 |
| GB | 1120067 | 7/1968 |
| GB | 1152038 | 5/1969 |
| GB | 1312701 | 4/1973 |
| GB | 1319726 | 6/1973 |
| GB | 1330778 | 9/1973 |
| GB | 2 017 645 | 10/1979 |
| GB | 2079256 | 1/1982 |
| GB | 2135278 | 8/1984 |
| GB | 2158044 | 11/1985 |
| NL | 6505562 | 10/1966 |
| WO | 82/01536 | 5/1982 |
| WO | 96/40566 | 12/1996 |
| WO | 98/07636 | 2/1998 |
| WO | 00/41937 | 7/2000 |
| WO | 2006/026783 | 3/2006 |
| WO | 2009/043038 | 4/2009 |

OTHER PUBLICATIONS

European Search Report for EP Application No. 09012612.9, Jan. 8, 2010.

European Search Report for EP Application No. 09156468.2, May 27, 2009.

European Search Report for EP Application No. 10251936.0, Jun. 8, 2011.

U.S. Appl. No. 61/167,776, filed on Apr. 8, 2009, "Stackable Low Depth Tray".

U.S. Appl. No. 61/184,768, filed Jun. 5, 2009, "Stackable Low Depth Tray".

Photograph of PEPSI—Blue Crate, Top View.

Photograph of PEPSI—Blue Crate, Bottom View 1.

Photograph of PEPSI—Blue Crate, Bottom View 2.

Photograph of Norseman NPL 405 Crate, Top View.

Photograph of Norseman NPL 405 Crate, Bottom View.

Photograph of Coca Cola Crate, Top View.

Photograph of Coca Cola Crate, Bottom View.

Photograph of 2L Coca Cola "Tulip" Crate, Top View.

Photograph of 2L Coca Cola "Tulip" Crate, Bottom View 1.

Photograph of 2L Coca Cola "Tulip" Crate, Bottom View 2.

Photograph of 2L Coca Cola "Tulip" Crate, Bottom View 3.

Exhibit 1: Four photos of a prior art case of Rehrig Pacific Company, Model No. PLBC-8-2L-PET-Qd (1984).

Exhibit 2: Two photos of a prior art case of Rehrig Pacific Company for 3 Liter PET bottles (1990).

Exhibit 3: Two photos of a prior art case of D.W. Plastics (date unknown).

Exhibit 4: Two photos of a prior art case of International Container Systems, Inc. For 3 Liter PET bottles (date unknown).

LOW DEPTH CRATE

This application is a continuation of U.S. application Ser. No. 12/619,143, filed on Nov. 16, 2009.

BACKGROUND OF THE INVENTION

The present invention relates generally to crates and more particularly to crates for carrying beverage containers, such as bottles.

Many designs for crates for carrying beverage containers are known. Some crates include a base having a pair of opposed side walls and a pair of opposed end walls extending upwardly from the periphery of the base. The crate may or may not have a plurality of interior columns extending upwardly from the base between the side walls and between the end walls to separate the bottles and partially define bottle receiving pockets.

For crates carrying smaller containers, e.g., approximately 16 to 24 ounce bottles, the bottles are typically arranged in a 4×6 arrangement, with four bottles arranged along each end wall. In this arrangement, the center of the handle is aligned between two of the bottles, thus providing sufficient room for the fingers of the user's hand grasping the handle. However, with slightly larger bottles, such as 1.5 liter bottles, arranged with only three bottles along each end wall, one of the bottles is aligned with the center of the handle, thus reducing the amount of space for the user's fingers.

SUMMARY OF THE INVENTION

A crate according to one embodiment of the present invention includes a base, a pair of opposed side walls extending upward from the sides of the base and a pair of end walls extending upward from ends of the base. The end walls each include a pair of spaced apart end columns each having a side flange partially defining a bottle receiving pocket and a lower rib projecting upwardly from the base between the side flanges. A handle extends across the pair of spaced apart columns at each end wall.

Any configuration where there is an odd number of bottles along the end wall (e.g., 3×4, 3×5, etc), the configuration of the handle and end walls will provide increased space between the handle and the bottle for the user's fingers when the user grasps the handle.

These and other features of the application can be best understood from the following specification and drawings, the following of which is a brief description.

DETAILED DESCRIPTION OF THE PREFERRED EMBODIMENT

Figure 1:
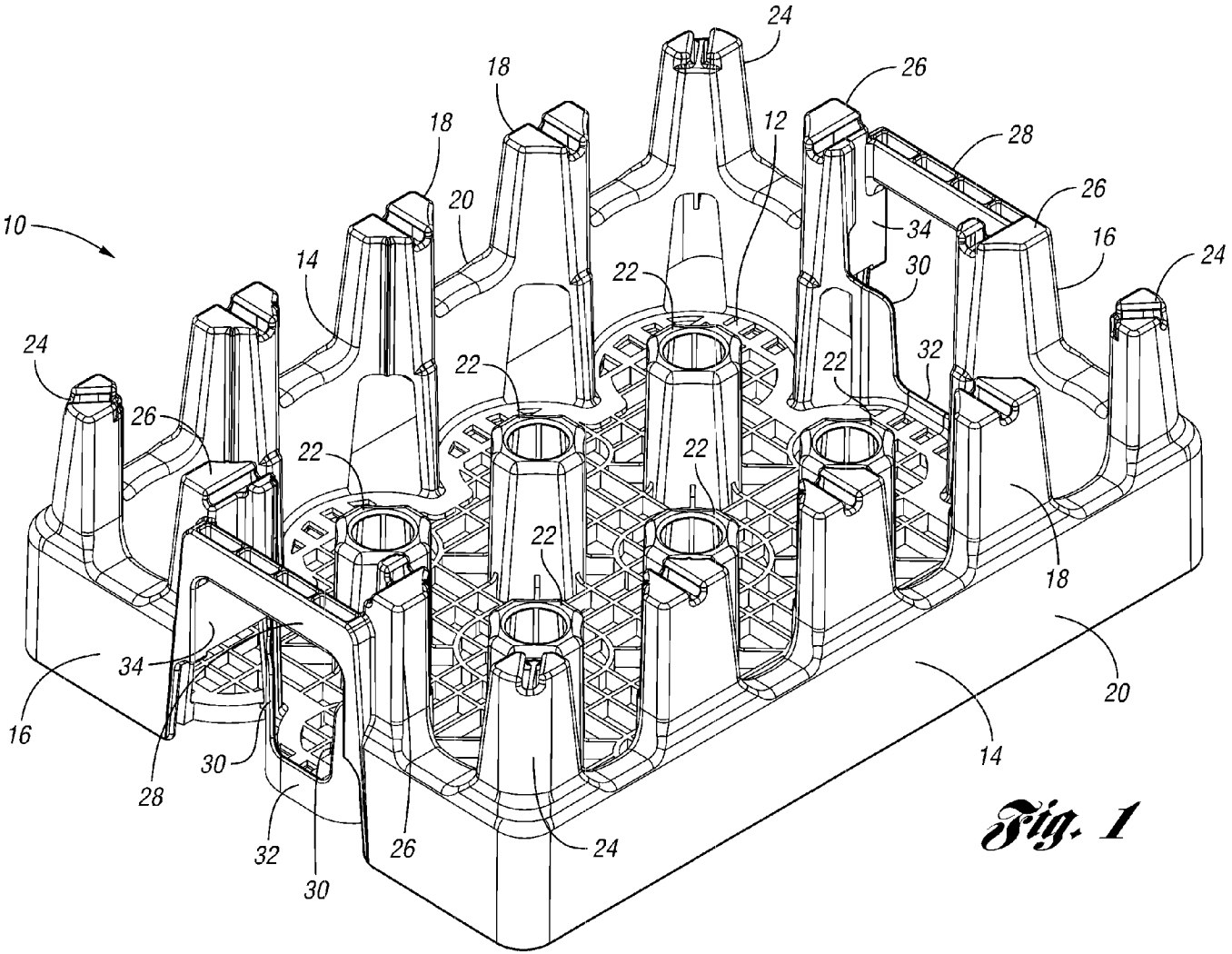
FIG. 1 is a perspective view of a crate according to one embodiment of the present invention.

A crate 10 according to one embodiment of the present invention is shown in FIG. 1. The crate 10 includes a base 12, which may include a plurality of interconnected ribs. The crate 10 further includes a pair of opposed side walls 14 extending upward from side edges of the base 12. End walls 16 extend upward from end edges of the base 12. The crate interior is defined between the side walls 14 and end walls 16.

A plurality of side columns 18 project upwardly from a lower portion 20 of the side walls 14. Interior columns 22 project upwardly from the base 12. Corner columns 24 project upwardly at the intersection of the end walls 16 and side walls 14. End columns 26 project upwardly from a lower portion of the end walls 16. A handle 28 extends between the end columns 26 at each end wall 16. The handle 28 extends along outer edges of the end columns 26. The end columns 26 are tapered toward the interior of the crate 10 while the handle 28 extends upwardly nearly perpendicular to the base 12, along an outer footprint of the crate 10. This maximizes the amount of potential space between the handle 28 and the nearest adjacent bottle.

A side flange 30 extends laterally from the end columns 26 and is continuous with a much shorter, lower rib 32, which connects the two side flanges 30. The side flanges 30 partially define a bottle receiving pocket and are part of a lower portion of the end columns 26. Above the side flanges 30, an upper rib 34 extends generally perpendicular to the base 12 and longitudinally relative to the crate 10 along an upper portion of the end columns 26 below the handles 28. The upper rib 34 does not contact the bottle or define the bottle receiving pocket or interfere with a user's hand grasping the handle 28.

Figure 2:
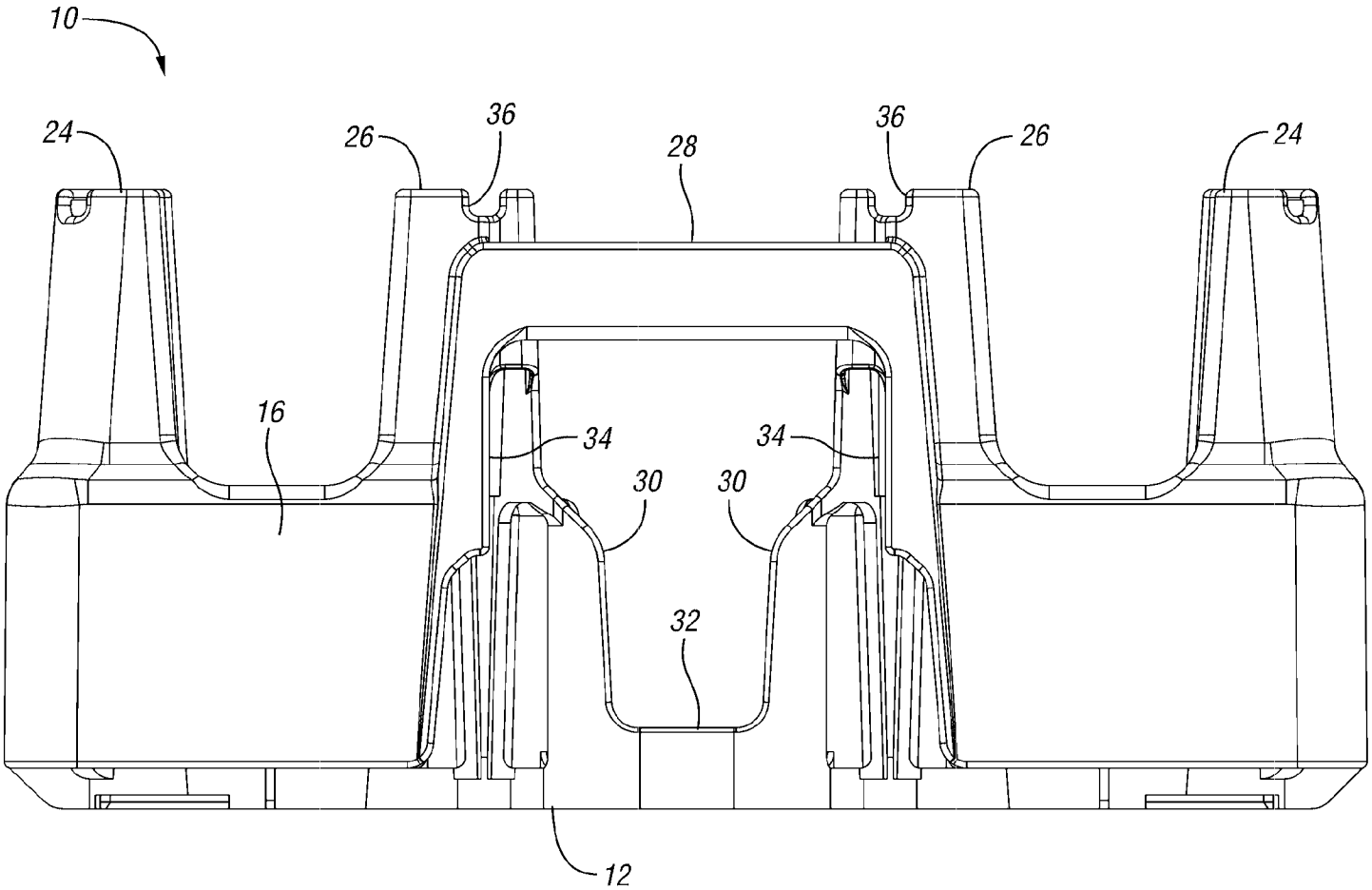
FIG. 2 is an end view of the crate of FIG. 1.

As shown in FIG. 2, the side flanges 30 generally correspond to the lower portion of the end walls 16. The lower rib 32 is significantly shorter, many times shorter than the side flanges 30. This creates a large opening above the side flanges 30 and a smaller opening between the side flanges 30 and above the lower rib 32 for accommodating the user's hand grasping the handle 28.

As also shown in FIG. 2, the columns, including the end columns 26, may include notches 36 into which the upper ribs 34 of a similar crate stacked on the crate 10 would be received.

Figure 3:
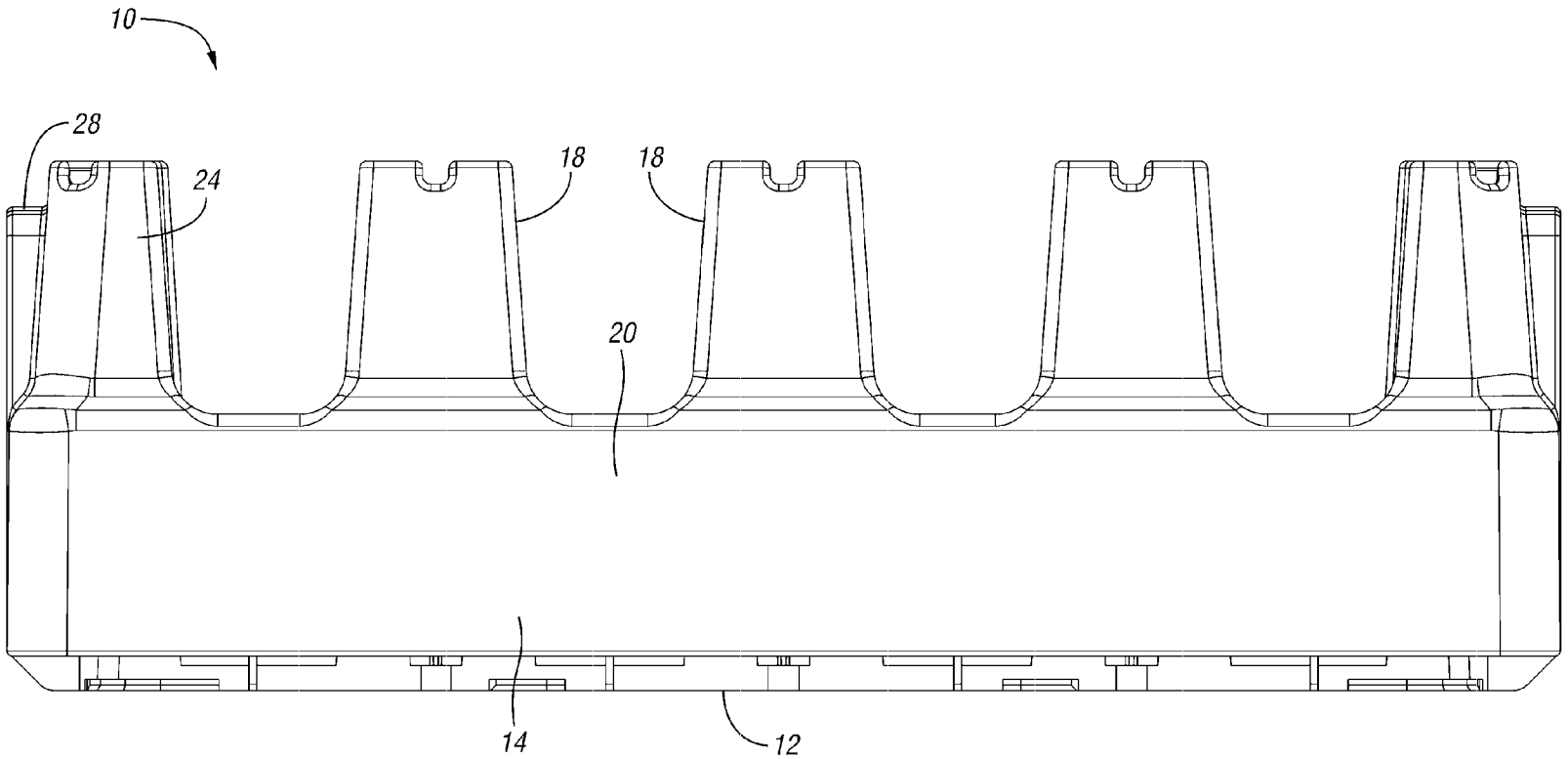
FIG. 3 is a side view of the crate of FIG. 1.

FIG. 3 is a side view of the crate 10. As is shown more clearly in FIG. 3, the handle 28 extends upward generally vertically relative to the base 12 along the outer footprint of the crate 10, while the columns taper inwardly.

Figure 4:
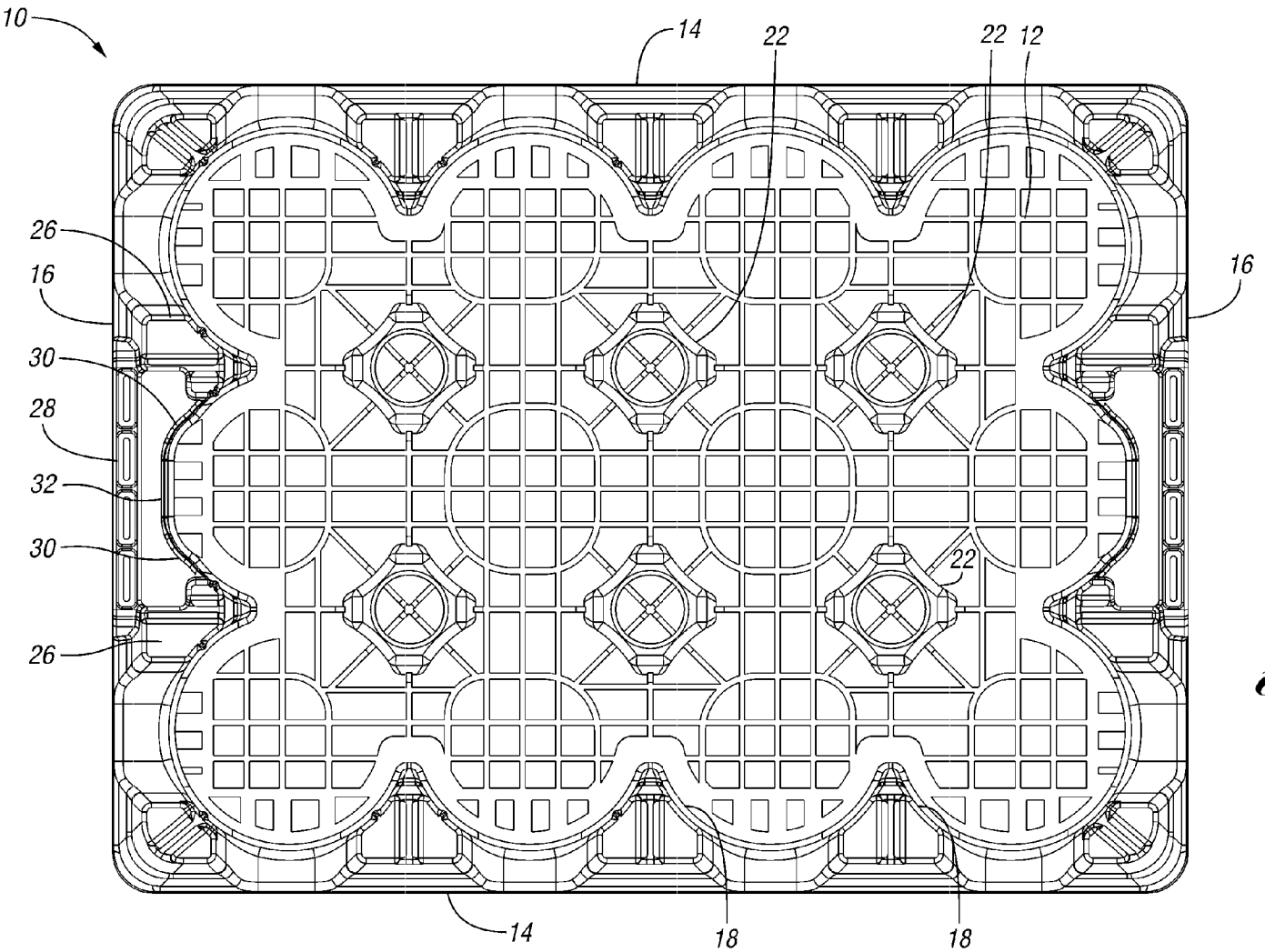
FIG. 4 is a top view of the crate of FIG. 1.

FIG. 4 is a top view of the crate 10. As can be seen in FIG. 4, there is a gap between the handle 28 and the lower rib 32, which defines the outer periphery of that bottle receiving pocket. The space between the inner surface of the handle 28 and the inner surface of the lower rib 32 (plus any contour or taper of the bottle) will be the amount of space that a user has for their hand while grasping the handle 28.

Figure 5:
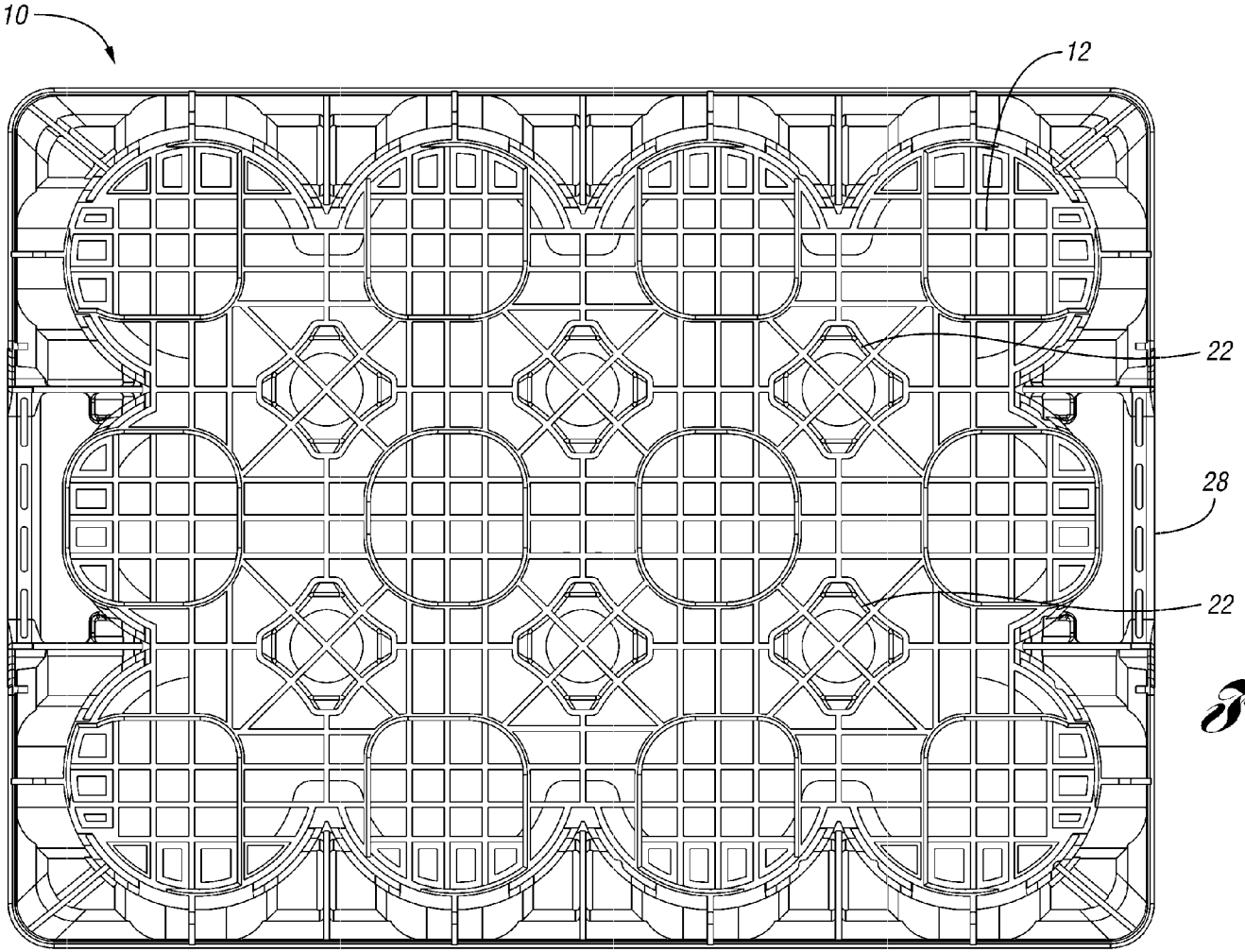
FIG. 5 is a bottom view of the crate of FIG. 1.

FIG. 5 is a bottom view of the crate 10.

Figure 6:
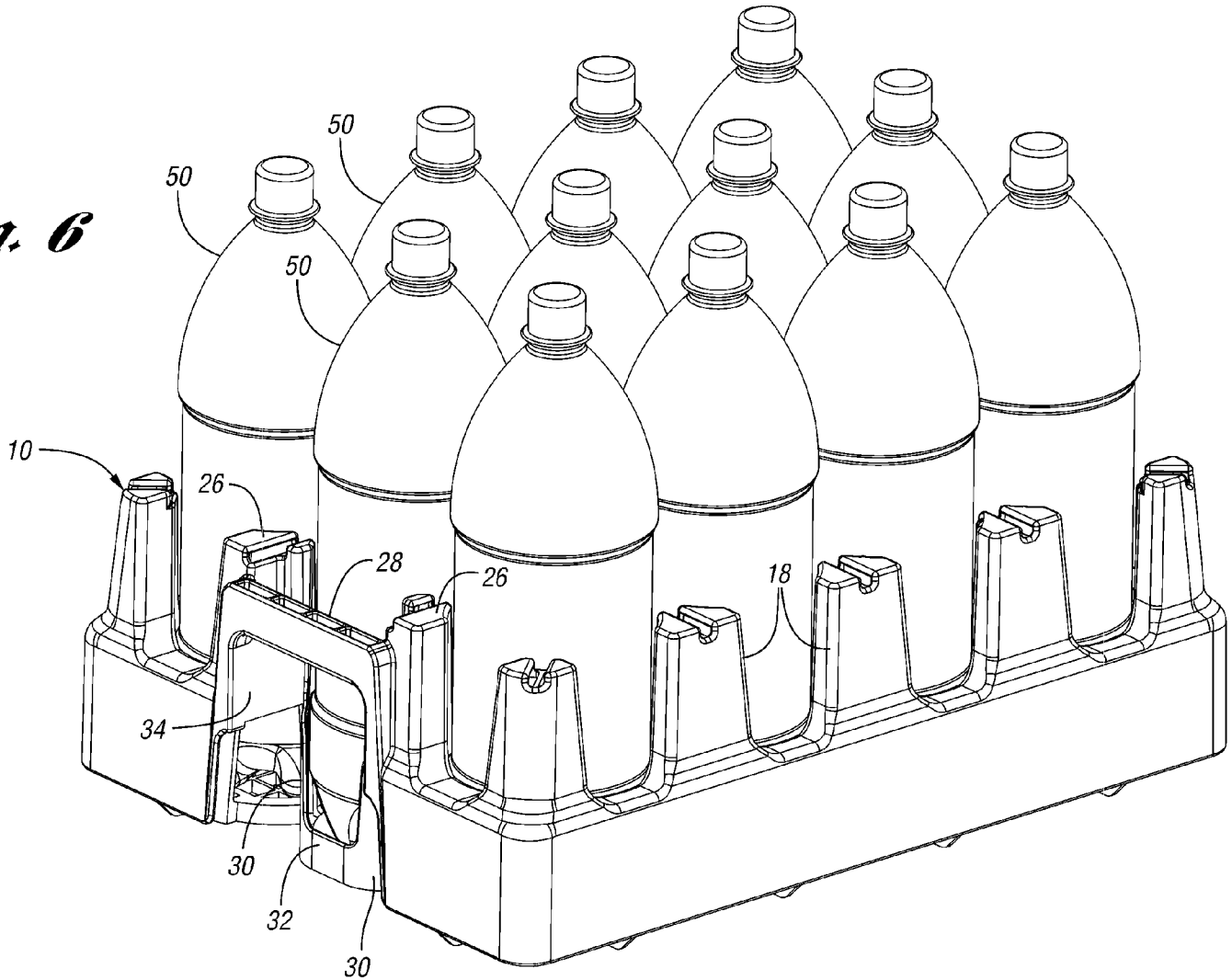
FIG. 6 illustrates the crate of FIG. 1 loaded with bottles.

FIG. 6 is a perspective view of the crate 10 with a plurality of bottles 50 stored therein. As shown, one of the bottles 50 abuts the end columns 26 and the side flanges 30. The bottle 50 may or may not abut the lower rib 32, depending upon the shape and taper of the bottle 50.

Figure 7:
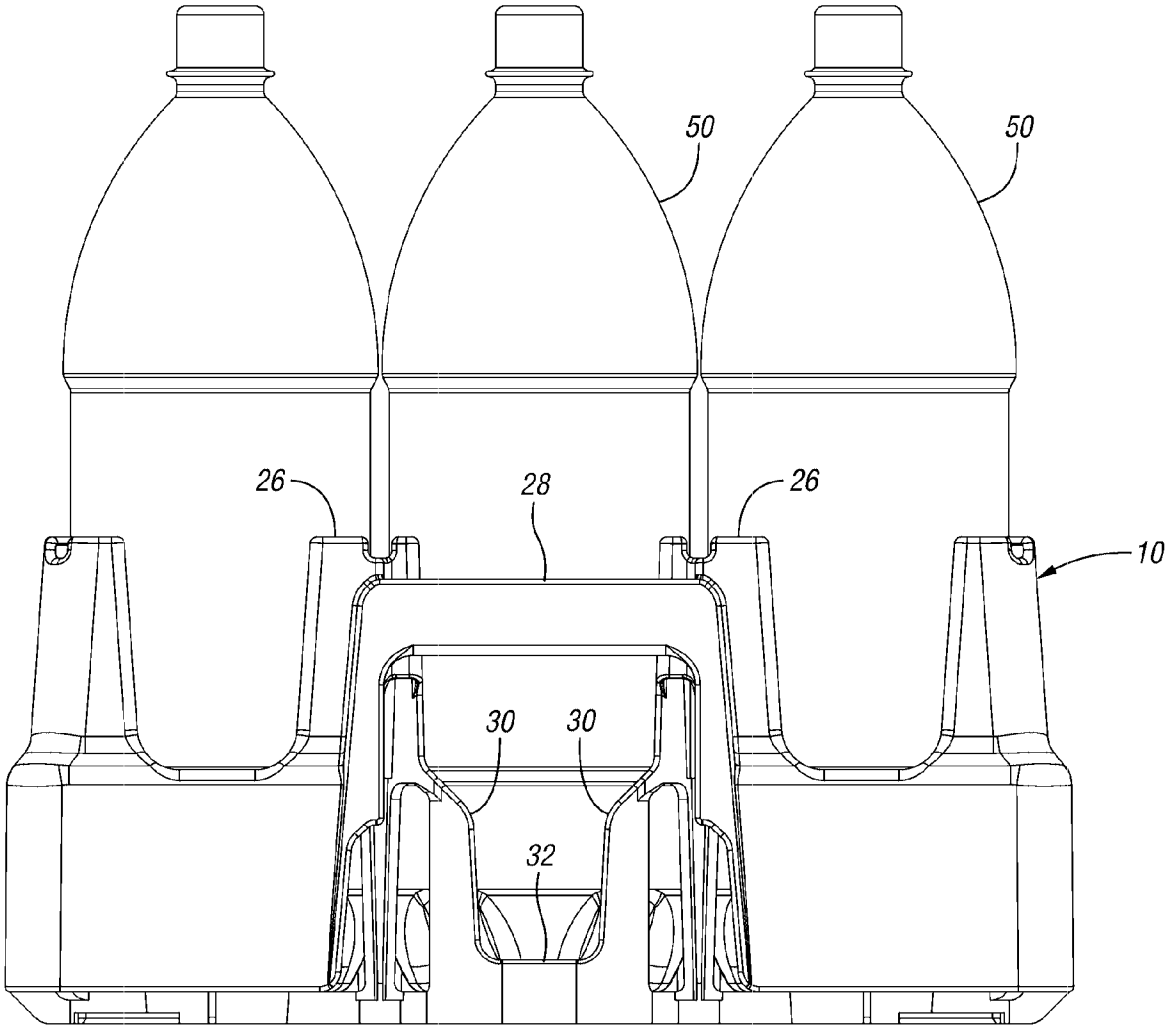
FIG. 7 is an end view of the crate and bottles of FIG. 6.
Figure 8:
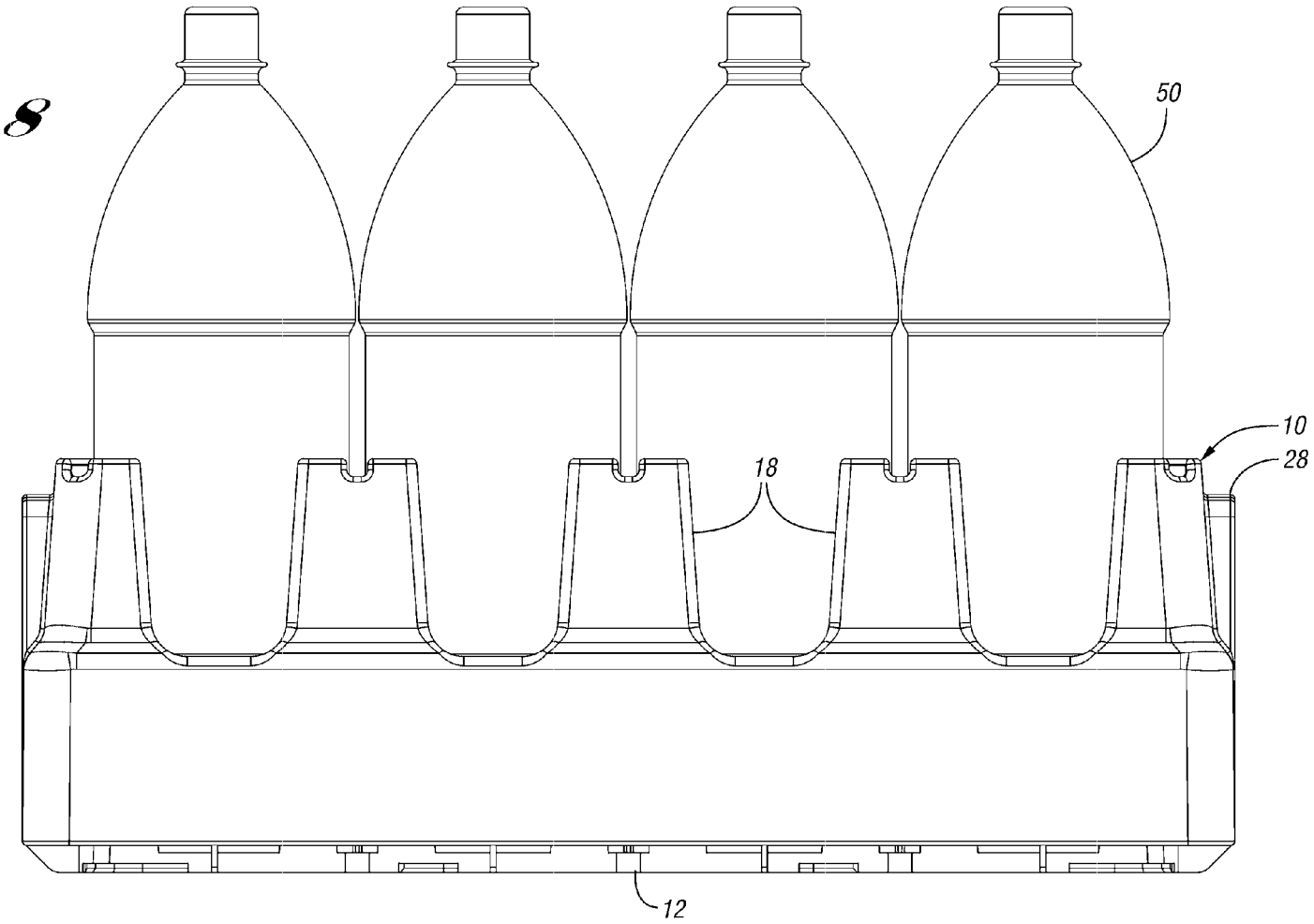
FIG. 8 is a side view of the crate and bottles of FIG. 6.
Figure 9:
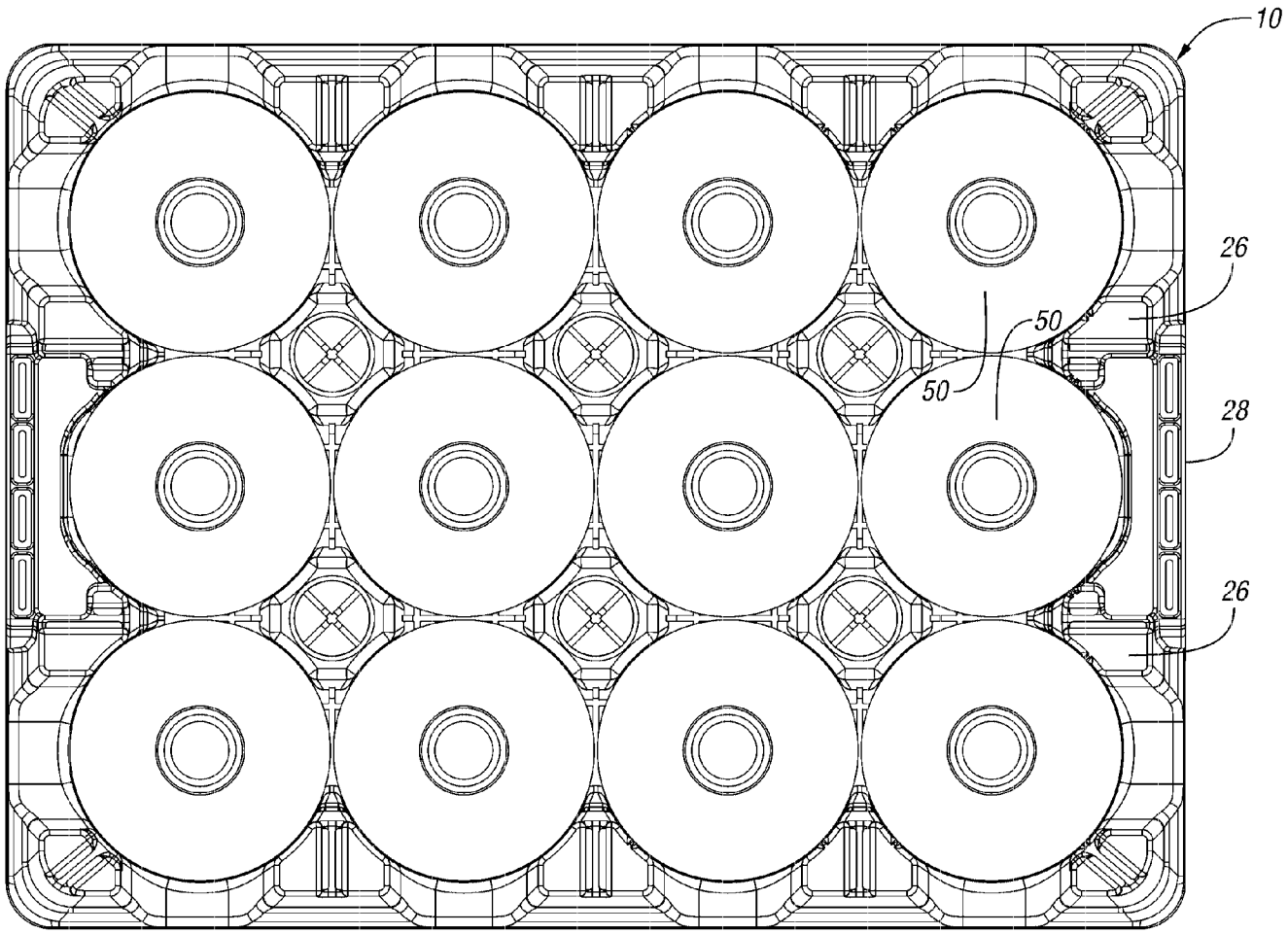
FIG. 9 is a top view of the crate and bottles of FIG. 6.

FIG. 7 is an end view of the crate 10 and bottles 50 of FIG. 6. FIG. 8 is a side view of the crate 10 and bottles 50 of FIG. 6. FIG. 9 is a top view of the crate 10 and bottles 50 of FIG. 6. As can been seen in FIG. 9, there is a gap between the inner surface of the handle 28 and the adjacent bottle 50 in which the user can place their fingers when grasping the handle 28.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A crate comprising:

a base;

a pair of opposed side walls extending upward from sides of the base;

first and second opposed end walls extending upward from ends of the base, the first end wall including a pair of spaced-apart end columns each having a side flange partially defining a bottle-receiving pocket, a lower rib projecting upwardly from the base between the side flanges; and a handle extending across upper portions of the pair of spaced-apart columns at the first end wall, further including a plurality of bottles in the crate including a first bottle in the bottle-receiving pocket, the first bottle spaced away from the handle to form a gap between the bottle and the handle in which fingers of a hand grasping the handle can be received.

2. The crate of claim 1 wherein the side flanges are spaced apart from one another, and wherein the lower rib is between the side flanges.

3. The crate of claim 2 further including a pair of rows of interior columns generally aligned with the end columns, such that the bottle-receiving pocket is defined between the end columns and two of the interior columns.

4. The crate of claim 3 wherein the side walls each include a lower portion and a plurality of side columns projecting upwardly from the lower portion.

5. The crate of claim 4 wherein the bottle-receiving pocket is generally centered on the handle.

6. The crate of claim 1 wherein the first bottle abuts the side flanges.

7. The crate of claim 1 wherein the handle is spaced outward of the lower rib, such that there is a gap between an inner surface of the handle and an outer surface of the lower rib.

8. The crate of claim 1 wherein the handle is spaced above the lower rib.

9. The crate of claim 1 wherein corner columns project upwardly at intersections of the end walls and side walls.

10. A crate comprising:

a base;

a pair of opposed side walls extending upward from sides of the base;

a pair of opposed end walls extending upward from ends of the base, the end walls each including a pair of spaced-apart end columns each having a side flange partially defining a bottle-receiving pocket, exterior surfaces of the end columns tapering inwardly of the crate; and a handle extending across upper portions of the pair of columns at each end wall, wherein the handle is disposed outward of the tapered exterior surfaces of the end columns and the end columns are configured to maintain a gap between a bottle abutting the end columns and the handle, the gap sufficient to receive fingers of a user's hand grasping the handle.

11. The crate of claim 10 wherein the side flanges are spaced apart from one another, and further including a lower rib extending upwardly from the base between the side flanges.

12. The crate of claim 10 further including a pair of rows of interior columns generally aligned with the end columns, such that the bottle-receiving pocket is defined between the end columns and two of the interior columns.

13. The crate of claim 10 wherein the side walls each include a lower portion and a plurality of side columns projecting upwardly from the lower portion.

14. The crate of claim 10 wherein the bottle-receiving pocket is generally centered on the handle.

15. The crate of claim 10 further including a plurality of bottles therein including a first bottle in the bottle-receiving pocket, the bottle spaced away from the handle.

16. The crate of claim 15 wherein the first bottle abuts the side flanges.

17. A crate comprising:

a base;

a pair of opposed side walls extending upward from sides of the base;

first and second opposed end walls extending upward from ends of the base, the first end wall including a pair of spaced-apart end columns each having a side flange partially defining a bottle-receiving pocket, a lower rib projecting upwardly from the base between the side flanges; and a handle extending across upper portions of the pair of spaced-apart columns at the first end wall, an upper rib extending from each end of the handle to each of the side flanges, the upper ribs generally perpendicular to the handle.

18. The crate of claim 17 wherein a bottle in the bottle-receiving pocket abuts the side flanges and is spaced away from the handle.

19. The crate of claim 17 wherein the handle is spaced outward of the lower rib, such that there is a gap between an inner surface of the handle and an outer surface of the lower rib sufficient to accommodate a user's hand between the handle and a bottle in the bottle-receiving pocket.

* * * * *